US005771845A

United States Patent [19]

Pistien et al.

[11] Patent Number: 5,771,845

[45] Date of Patent: Jun. 30, 1998

[54] VAPORIZATION METHOD DEVICE

[75] Inventors: Jacques Pistien, Iles Saint-Denis; Jean-Louis Giazzi, Argenteuil; Robert Desage, Verneuil Sur Seine; Philippe Deblay, Chatenay-Malabry, all of France

[73] Assignees: Gaz De France, Paris; Cogia, Palaiseau; Superba, Mulhouse, all of France

[21] Appl. No.: 583,121

[22] PCT Filed: May 18, 1995

[86] PCT No.: PCT/FR95/00656

§ 371 Date: Apr. 8, 1996

§ 102(e) Date: Apr. 8, 1996

[87] PCT Pub. No.: WO95/31674

PCT Pub. Date: Nov. 23, 1995

[30] Foreign Application Priority Data

May 18, 1994 [FR] France ..... 94 06076

[51] Int. Cl.[6] ..... F24F 6/08

[52] U.S. Cl. ..... 122/366; 122/5.52; 392/395; 239/145

[58] Field of Search ..... 454/291, 328; 122/5.52, 39, 366; 392/402, 395; 239/145, 44

[56] References Cited

U.S. PATENT DOCUMENTS

| | | | |
|---|---|---|---|
| 3,869,242 | 3/1975 | Schladitz | 431/11 |
| 3,977,364 | 8/1976 | Gijsbers et al. | 122/366 |
| 4,419,302 | 12/1983 | Nishino et al. | 392/402 |
| 5,267,611 | 12/1993 | Rosenfeld | 122/366 |

FOREIGN PATENT DOCUMENTS

| | | |
|---|---|---|
| 330901 | 8/1903 | France . |
| 2144355 | 2/1973 | France . |
| 2211268 | 7/1974 | France . |
| 158050 | 2/1905 | Germany . |
| 3732321 | 4/1989 | Germany . |

*Primary Examiner*—Harold Joyce
*Assistant Examiner*—Gregory A. Wilson
*Attorney, Agent, or Firm*—Rothwell, Figg, Ernst & Kurz, p.c.

[57] ABSTRACT

A liquid is vaporized by a device having at least one porous substrate exposed to a certain ambient pressure, means for supplying the substrate with liquid in order for it to be loaded with liquid starting from an upstream portion of the substrate, and at least one energy source for heating the substrate so that at least some of the liquid is vaporized. According to the invention, the means for supplying the substrate with liquid may include means for pressurizing the liquid to a pressure greater than ambient pressure, thereby creating a flow-rate greater than the flow-rate induced by capillarity and vaporization of the liquid alone when the substrate is held in a horizontal position. The invention may be applied to the production of water-vaporization equipment, particularly with electrical or gaseous energy supply.

21 Claims, 6 Drawing Sheets

VAPORIZATION METHOD DEVICE

FIELD OF THE INVENTION

The present invention relates to a method and to a device for vaporizing a liquid.

BACKGROUND OF THE INVENTION

It is known that, to vaporize a liquid, an electrical resistor immersed in a relatively significant depth of water may be used. With this concept, the time required to heat the liquid in order to vaporize it is relatively long and the vaporization yield is mediocre, particularly with sequential operation. This is the case, for example, with a certain number of steam boilers using combustion gases.

However, a steam generator is known from French patent FR 78 08 201 which, although it uses an electrical resistor for beating a porous body immersed at its base in a layer of water, has the characteristic of vaporizing the water contained in the porous body relatively quickly. The water is replaced by the pumping capacity of the porous body. In order to achieve an optimum yield, the depth of the layer of water is regulated in dependence on the density of the heat flux transmitted to the body, according to its pumping capacity. This method is applicable to all kinds of energy such as combustion gases, for example.

Although the use of the pumping capacity of a porous body can thus improve the performance of steam boilers in certain cases, there are limits since the quantity of liquid contained in the body decreases with the pumping height. A first consequence of this phenomenon is that, in practice, it limits the height of a porous body to a few cm and a second consequence is the maintenance of a small differential of variation of liquid depth if the yield is to be optimized in dependence on the heat-flux density.

Patent DE-C-158 050 may be considered in a certain way to be an example of this type of steam boiler.

Thus, in this German patent it is known, in particular, to provide the liquid vaporization device described:

with at least one porous substrate (that is, with capillary properties) exposed to a certain ambient pressure, with means for supplying the substrate with liquid so that it is loaded with liquid by the flow of the liquid in the substrate starting from an upstream portion, and with at least one energy source for heating at least one vaporization region of the substrate, situated downstream of the upstream portion, and the liquid with which it is loaded, so that a least some of this liquid is vaporized therein.

In this patent, however, several wicks are used as the substrate and are supplied "by the effect of the suction force", that is the capillary pumping of the said wicks.

In so far as, as indicated above, the flow-rate of a wick supplied by capillary pumping decreases with the depth of the layer of supply water, FIG. 4 of DE-C-158 050 shows the advantage which may be achieved with the use of several supply containers disposed at different levels, the highest placing the substrate horizontally.

Tests carried out with d device or this type, however, show that the yield remains mediocre and that the quantity of liquid in the vaporization region quickly becomes too small, the time taken for the liquid to reach this vaporization region often being too long.

Moreover, the device of DE-C-158 050 is bulky and is not favourable for present-day industrial application, which requires high yield, compactness, low mass-production cost, reliability over time, etc.

SUMMARY OF THE INVENTION

The object of the invention is to provide a solution to a number of the problems mentioned above and, in particular, the invention proposes a method which can be implemented industrially in commercially advantageous conditions without exorbitant manufacturing and/or maintenance costs and which also offers flexibility of use and performance and reliability suitable for current needs.

The solution of the invention consists, in particular, for a given vaporization operation corresponding to certain energy-supply conditions, of establishing in the substrate ("capillary") an input flow-rate of liquid greater than the input flow-rate of liquid induced by capillarity and the vaporization of the liquid alone in the same substrate when in a horizontal position, the first-mentioned position of the substrate not necessarily being horizontal.

In order to achieve this, in the device of the invention, the means for supplying liquid to tho substrate in question comprise means for pressurizing the liquid in order to establish therein a pressure greater than the ambient pressure.

To prevent any ambiguity, the way in which the flow-rate induced as indicated above "by capillarity and vaporization alone in the same substrate (naturally for the energy-supply conditions) with the substrate assumed to be in a horizontal position in that case" will advantageously be measured is shown in FIG. 1.

The substrate 7A in question will thus first of all be placed horizontally with its surroundings so that the effect of gravity on the capillarity forces in particular can be disregarded.

An end 7A, of this substrate is then dipped in a container 5A containing a quantity $Q_1$ of liquid to be vaporized. Naturally this will be an "available" liquid, i.e., simply a sufficient quantity, such as liquid with which a container has been filled.

The substrate will then be exposed to a given heating energy supplied by suitable means 19A. This "heating energy"

1) must enable the liquid which in the meantime has "migrated" from the container 5A into the substrate according to the arrow 6 to be vaporized (at least partially), 2) and must also be reproducible in an identical manner in the device of the invention, including the heat-exchange wall 21A if one is to be used to implement the invention. (If an electrical resistor is used, the same resistance supplied with the same intensity must be used for the comparison; for gas, the same burner must be used and must be supplied in the same conditions.)

The "dry" substrate 7A having been placed in the container, a knowledge of the quantity $Q_2$ or weight of liquid which has entered the substrate (and hence left the container) over a given time interval enables the "induced flow rate" of the liquid input to the substrate to be determined.

It will be noted that the "flow-rate of liquid under pressure" which is characteristic of the invention will be achieved favourably with the use of fine substrates (which may advantageously be of the order of or less than 2 mm thickness) which can only favour the discharge of the steam. This solution is also advantageous in terms of the speed of conversion of the liquid to the vapour phase and, more generally, of yield.

In the present invention, in order to achieve the desired flow of liquid in the substrate, it is possible, in particular, to use the weight of a column of liquid or to force the liquid into the substrate, for example, with a pump.

Another solution may also consist of:

inclining the substrate to the horizontal, creating the column of liquid in the substrate, and creating an increase in pressure in this column.

The increase in pressure may be brought about, in particular, by a pump

According to another characteristic of the invention, it is advisable to form the substrate of the present vaporization device with a thickness of between about 0.05 mm and 5 mm and preferably less than 2 mm.

Moreover, the substrate advantageously has a porosity of between about 5% and 90% and the substrate used will include empty spaces for retaining liquid such that the liquid can occupy between about 5% and 100% of the said empty spaces.

Thus, in contrast with the very thick wicks of the vaporization devices using (very predominantly) capillary pumping, the use or a substrate which is almost in the form of a thin porous film offers the advantage that the heat flux generated is faced with only a small depth of liquid to be vaporized in or on the surface of the substrate, with the consequence of a particularly rapid change to the vapour phase which may take a few seconds, with a yield which can be particularly high.

In particular, by combining a substrate formed as a thin film and a flow rate of liquid responding to the aforementioned requirements of the invention, it has been found that, for a constant heat-flux density, there was a variation of the vaporization yield simultaneous with the variation of the flow-rate of the liquid in the substrate. Conversely, with a constant flow-rate of liquid, there was a variation of this same vaporization yield simultaneous with the variation brought about in the heat-flux density. It was also possible to achieve a maximum vaporization yield for an equilibrium condition between the flow-rate of vaporizable liquid entering the "film" constituting the porous substrate and the heat flux delivered to the substrate, with a vapour which, in that case, was practically free of moisture.

It also appeared that, in order to cover a large range of heat-flux densities, it was necessary to use different thicknesses of porous films constituting the substrate, while very advantageously conforming to the above-mentioned characteristics. For each of these thicknesses and according to the nature of the porous substance, it was found, in particular, that it was possible to achieve a range of usage of the flow-rate of liquid to be vaporized between a minimum content in transit and the maximum quantity of liquid saturating (or supersaturating) the porous film.

If a very good vaporization yield is not particularly required, a characteristic of the invention also provides for an increase in the range of flow-rates of the liquid to be vaporized by supersaturation of the substrate so that some of the liquid flows over a free outer surface thereof, while being kept against the substrate by surface tension.

A simple way of regulating the flow-rate of liquid into the substrate consists of inclining the substrate to the horizontal.

It is thus possible, as indicated above, to create a column of water in the region of the substrate directly exposed to the heat flux and possibly above it in order to take advantage of the effect of gravity. When the flow-rate of liquid is greater that the heat-flux density, the excess liquid flowing out of the lower portion of the substrate can be recovered in order to be readmitted to the upper portion.

When the effect of gravity is not used directly, another way of supplying liquid consists of admitting it under pressure into all or part of the cross-section of flow of the substrate. The substrate can thus be arranged in a manner such that it is immersed at two opposite ends (between which the liquid to be vaporized flows along it) in a pipe to which the liquid will be supplied by forced circulation means. This could also be the case, for example, if the device were to be operated with substrates arranged horizontally. In this connection, the following tabular data shows, first of all, the effect or the pressure of a column of liquid on its flow-rate in the porous substrate and then the effect of the inclination of the substrate on the same flow-rate of liquid, in the particular case of a porous substrate constituted by a film, for example, of woven cotton 0.2 mm thick and 120 mm wide.

Effect of the depth of the porous film on the flow-rate of liquid:

| | | | | | |
|---|---|---|---|---|---|
| Height of the porous substrate in mm | 30 | 60 | 90 | 130 | 180 |
| Flow-rate of water in milliliters per minutes | 2.3 | 6.6 | 11 | 16 | 31 |

Effect of the inclination of the porous film on the flow-rate of liquid:

| | | | | | |
|---|---|---|---|---|---|
| Angle of inclination to the vertical | 0° | 15° | 65° | 75° | 90° |
| Flow-rate of water in milliliters per minute | 5.5 | 1.7 | 1.2 | 0.5 | 0.3 |

In order to supply the substrate of the device of the invention with the desired flow-rate of liquid, according to another characteristic of the invention, it is possible to use dripping means, thus taking advantage, for example, of the capillary pumping of an additional porous body immersed in a suitable reservoir. It is also possible to use a liquid spray diffuser which sends the liquid to be vaporized onto the substrate, or even immersion of the porous substrate, at least a portion of which receives the heat-flux energy, directly in a layer of water, the level of which can be varied. It is also possible to use a pump for circulating the liquid under pressure in a pipe which is bent locally and between two of the branches of which the porous substrate has previously been disposed in a manner such that its ends are dipped in the liquid in the pipe.

It will also be noted that the liquid in the substrate can be vaporized in particular by all or some of the following three heat-transfer methods: radiation, conduction, or convection, either from combustion gases or from an electrical source, depending for example, on operating conditions which may be at a pressure lower than, higher than, or equal to atmospheric pressure, the vaporization of a number of different liquids such as water, alcohol, liquid petroleum, etc, being envisaged.

With regard to the porous substrate of the invention, it will also be noted that it could be made of cotton fibres or threads or even of mineral fibres such as, for example, glass or quartz fibres or even metal wires such as steel wires. The formation of the substrate from porous and permeable materials produced by sintering of metallic powders also is envisaged.

In practice, two types of substrate may be preferred: a substrate formed as a permeable sheet of flexible, fibrous fabric, or a plate of more rigid structure.

In the foregoing, reference has always been made to the use of a single substrate. The use of several substrates is, however, entirely expected. In particular, in certain cases, it could be advantageous to replace a single substrate of a certain area with several substrates of smaller dimensions, the total area of which is the same or the single substrate, each smaller substrate being able, in particular, to be supplied by its own means for supplying liquid, thus creating the same number of vaporization regions which may potentially be optimized individually.

If several substrates are used, it is possible, in certain applications, to provide, in particular, for the substrates to be arranged in positions in which they are inclined to the horizontal and to make them overlap partially so that they are separated from, one another over at least a portion of their area in order to leave between them a space which is favourable, in particular, for the vapour flow.

If at least two substrates are used, these substrates may also advantageously extend on each side of the heat source, thereby enclosing it.

Finally, before the invention is described in greater detail with reference to the accompanying drawings, it will also be noted that, particularly when the energy source comprises at least one gas burner, the device of the invention may advantageously comprise two hollow chambers defining between them a chimney in which the combustion products or the burner will then flow, each of these chambers enclosing at least one substrate.

DESCRIPTION OF THE DRAWINGS

With reference now to the appended drawings, in addition to FIG. 1, which shows an arrangement for determining a liquid flow rate, these are arranged, by way of non-limiting example, as follows.

DETAILED DESCRIPTION OF PREFERRED EMBODIMENTS

Reference will be made below solely to the vaporization of water, although other liquids may be vaporized by the same devices.

Figure 2:
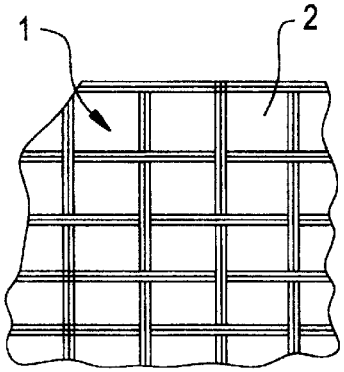
FIG. 2 shows a possible substrate structure according to the invention.

FIG. 2 shows an embodiment of a porous "film" 1 with capillary properties, of cotton of the "honeycomb" type with square mesh openings 2 of about 30 to 50 $mm^2$. Like all of the substrates compatible with the invention, this thus has a structure incorporating empty spaces for retaining liquid to be vaporized, these spaces being constituted, in this case, by the spaces between the threads of the mesh and by the structural empty spaces within the threads themselves. The central portion of the substrate 1 shown is a woven fabric of threads of different thicknesses according to the desired flow capacity selected. In this case, this substrate is constituted peripherally by threads three times thicker than those of the central portion. A peripheral buffer for reserving and diffusing the water towards the central portions of the mesh is thus created.

In the invention, the selection of the permeable substrate is important. It will be seen from the following that its thickness is always between about 0.05 mm and 5 mm with a porosity to the liquid to be vaporized of between about 5 and 90%.

Figure 3:
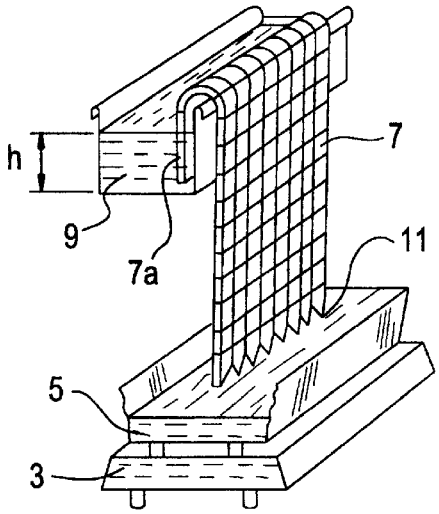
FIG. 3 is a perspective view of an assembly for measuring the flow-rate in a porous substrate, in dependence on the depth of its layer of supply water.

For a better understanding of the operation of the following embodiments, FIG. 3 is an example of an experimental device for the supply, by pumping, of a fine porous substrate in the depth of a layer of water. This device permits adjustment of the flow-rate of the liquid which flows from the output of the supply container under the effect of gravity. It is composed or a balance 3, a container 5 for collecting the water flowing from the porous "film" 7 and a water container 9 in which the upper portion 7*a* of the porous substrate is immersed. To achieve a constant and free flow-rate throughout the width of the cross-section of flow of the porous film, the lower portion of the film has been notched at 11. The flow-rate measurement consists of variation of the depth h of the water in the tank 9.

The following table indicates the characteristics of use of three thicknesses of porous substrates which may have square meshes of the type shown in FIG. 2.

| TYPE OF POROUS COTTON SUBSTRATE | THICKNESS OF THE SUBSTRATE | SATURATION WATER-STORAGE CAPACITY ($g/cm^2$) | HEAT-FLUX DENSITY OF SUBSTRATE (W/cm2) |
|---|---|---|---|
| small mesh | 0.2 mm | 0.104 | from 1 to 2.5 |
| medium mesh | 0.5 mm | 0.142 | from 2.5 to 4.5 |
| thick mesh | 1 mm | 0.196 | from 4.5 to 10 |

Figure 4:
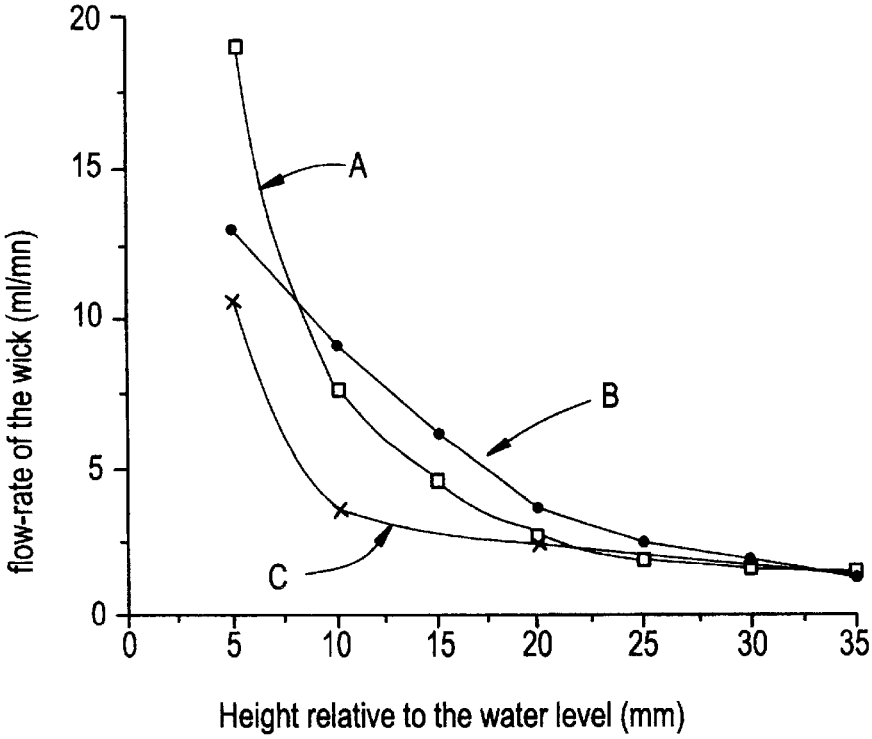
FIG. 4 is a graph showing the variation of the flow-rate of water in a porous substrate according to the invention as a function of the depth of its layer of water.

FIG. 4 is a graph which indicates the flow-rate of water flowing into a vertical small-mesh porous film (that is of thickness <1 mm, for a unitary mesh area of the order of 0.05 $mm^2$) as a function of the depth of the layer of water. Curve (A) measures the flow-rate of water flowing freely as far as the lower portion of the substrate. Curve (B) measures the flow-rate of water when the lower portion of the same porous film is immersed in 2 cm of water. Curve (C) measures the flow-rate when the film is laid against a metal wall without its lower portion being immersed.

It is thus possible, according to the conditions of use of the substrate, to vary the flow-rate of the liquid flowing therein in a ratio of from 1 to 8 according to curve (A), in a ratio of from 1 to 5 according to curve (B), and close to that according to curve (C) when the porous film is laid against an exchange wall.

Figure 5:
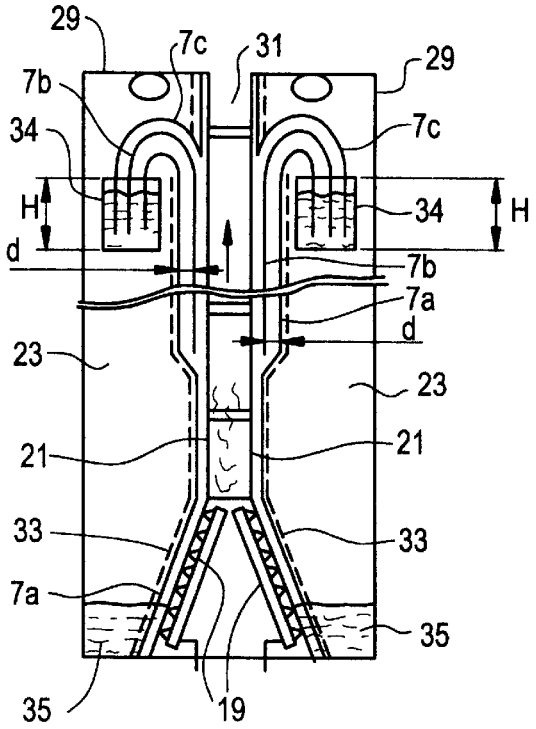
FIGS. 5 and 6 are a side view and a partial cut-away perspective view, respectively, of a steam generator according to the invention.
Figure 6:
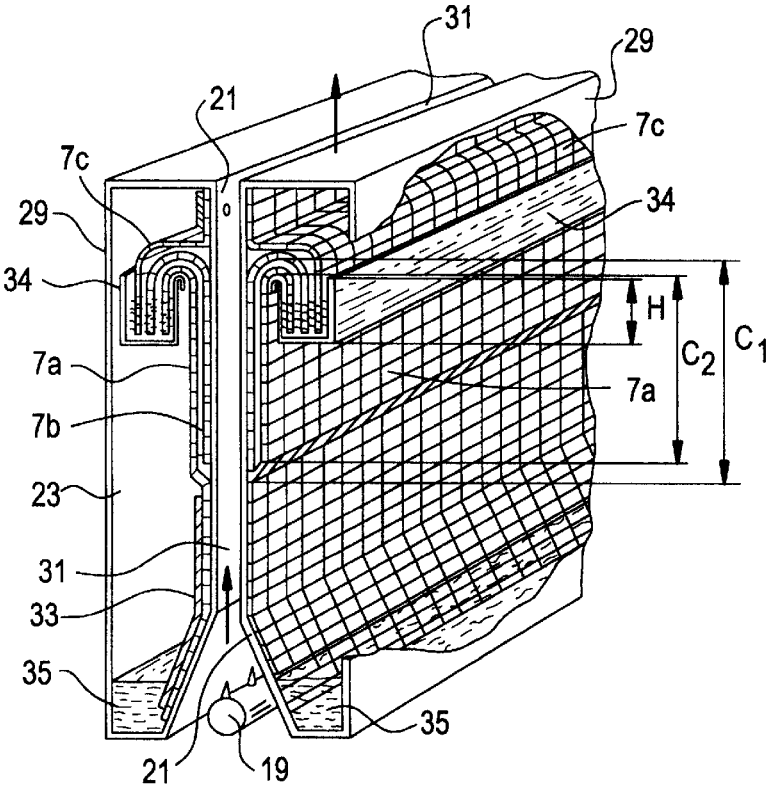

The steam boiler shown in FIGS. 5 and 6 vaporizes water held in porous films laid against the heat-exchange walls 21. In this type of boiler, the heat transfer can be achieved equally well by a gas burner such 19, with a supply or atmospheric air, or with blown air or by one or more radiant burners. In the first case, the heat transfer takes place mainly by convection, whereas in the second it takes place mainly by radiation.

Several substrates 7*a*, 7*b*, etc. are preferably used, disposed in two separate chambers 23 each defined by two essentially parallelepipedal hollow metal chambers 29 which are set up in two substantially parallel vertical planes while being separated from one another so as to keep between them an intermediate space 31 usable as a chimney for the discharge of any fumes produced by the burner which is preferably disposed in the lower portion of the space 31 in a region where the space has a frusto-conical shape converging in the direction in which the fumes are discharged. The chimney is closed laterally by walls (not shown).

In particular, each partition 21 is equipped internally with three porous films 7*a*, 7*b*, 7*c* extending respectively over about half of the height of the exchange wall, over ¾ of the remaining height, and over the uppermost ¼. A netting 33 with large open meshes with a ratio of 90% and having a mesh area of 4 $cm^2$ is applied to each porous film in order, on the one hand, to ensure good thermal contact with the substrates and, on the other hand, to leave a passage way for the steam produced. Each chamber 29 also has an upper container 34 in which "upstream" portions of the three porous films (which, in this case, are of the same thickness), are immersed. It will be noted that, in order for its top portion to reach as far as the tank 34, the porous film 7*a* is kept separated from that marked 7*b* (space d). The entire column of water C1 stored in the thermally-protected upper portion of the film 7*a* thus serves to supply, under a suitable pressure (greater than the ambient pressure prevailing in the chamber in question), its lower portion which is laid against the partition 21 and hence is fully active in terms of heat-exchange and vaporization capacity. The same also applies to the film 7*b* but with a column C2 of lesser height, practically the entire column being exposed to the heat-flux in this case. In the lower portion of each of the chambers, the water which is collected in a suitable lower reservoir when the flow-rate in the films is greater than that which can be vaporized by the flux is indicated 35. When this excess water reaches a predetermined level it may be readmitted to the container 34 by a pump.

Figure 7:
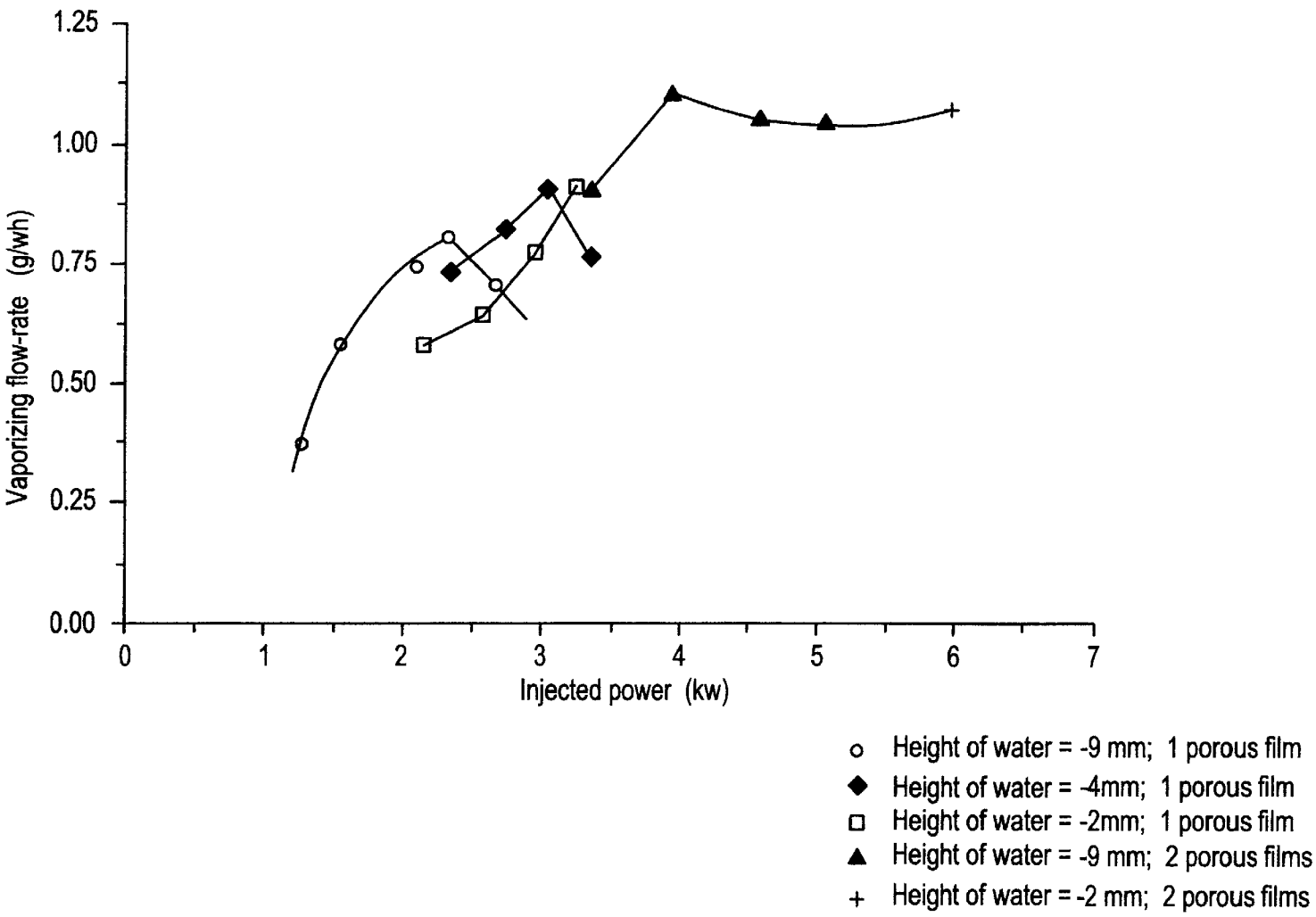
FIG. 7 is a graph showing, for an installation of the type shown in FIGS. 5 and 6, the variation of the vaporization yield as a function of the heating power generated, for various depths of water available and for two different thicknesses of porous substrates.

FIG. 7 is a graph which shows the effect of the number of substrates and the depth of water on the vaporization yield as a function of the power input both with a single porous film of the "small-mesh" type mentioned above, replacing the two substrates 7*a*, 7*b*, and with these substrates themselves. In each case, the measurement consists of variation of the depth of the layer of water in the container 34, it being specified that, in this particular embodiment, the container has been placed at about ⅘ of the height of the exchange walls.

On one of the curves for a single porous body and with reference to a water depth of H-9 mm relative to the maximum height H permitted up to the upper edge of the container, there is an increase in yield of from 0.30 g/Wh to 0.8 g/Wh and then a decrease thereof to 0.65 g/Wh when the power input is changed from 1.2 kW to 2.4 kW.

When the power is increased again and the depth of water is also increased to H-4 mm, the same shape of curve is observed (marked by diamonds) with a yield again increasing up to 3.2 kW and then decreasing at 1.4 kW. This decrease in yield is even greater at H-2 mm to reach a value of 0.9 g/Wh.

If two porous bodies are put in place and the water depth is taken to H-9 mm, the yield is again increased to 1.10 g/Wh for a power of 4 kW, a yield in the vicinity of this power then being retained up to a water depth of H-2 mm.

It is thus necessary to adjust the water depth in dependence on the power of the heat source if optimum yield is to be achieved. In contrast, beyond this optimum, the yield decreases if the power is increased, owing to too small a flow-rate of liquid in the substrate. It is also found that the vaporization yield increases when two substrates are provided for the same exchange surface.

Moreover it is found that, with a practically constant power of 2.4 Kw, the vaporization yield changes from 0.6 g/Wh to 0.8 g/Wh, that is, a gain of 30% in the yield of the boiler. This gain is achieved when the water depth is changed from H-2 mm to H-4 mm and then to H-9 mm.

Figure 8:
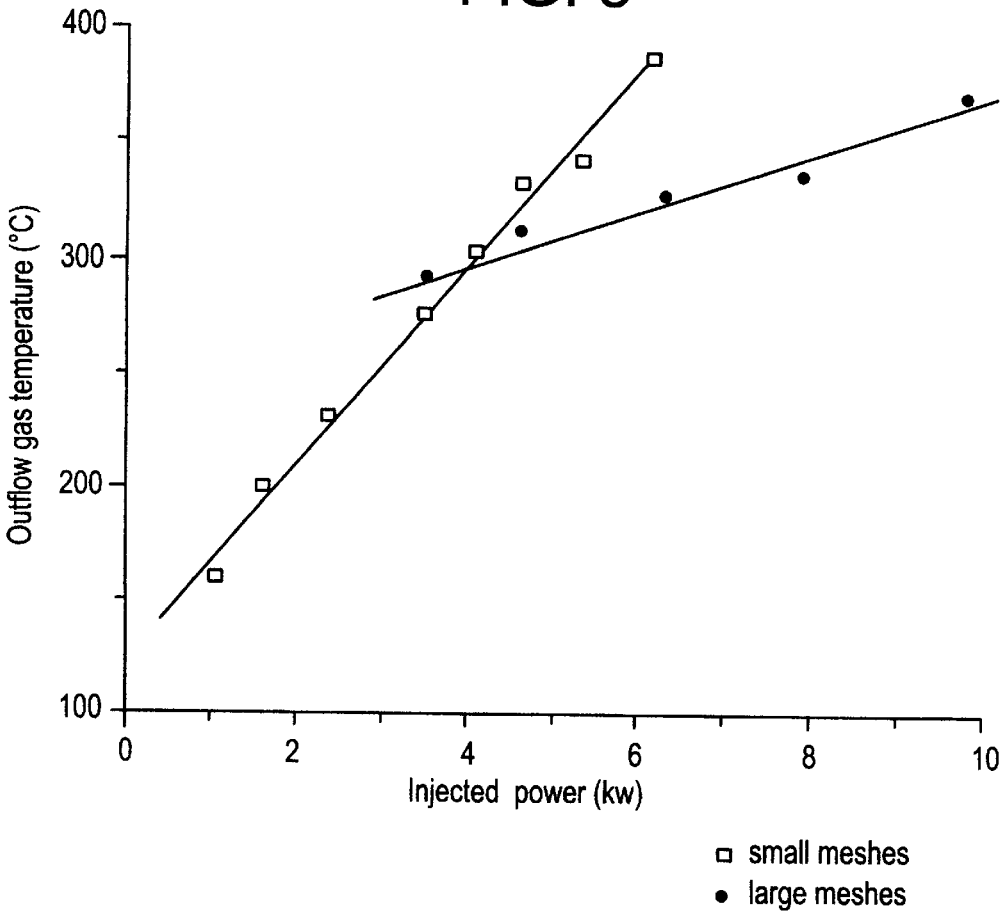
FIG. 8 is a graph showing, as a function of the power input, the effect of the thickness of the substrate on the output gas temperature for an installation, as shown in FIGS. 5 and 6.

For a steam boiler corresponding to that of FIGS. 5 and 6, the graph of FIG. 8 shows the effect of the thickness of the substrate(s) on the temperature of the gases output from the boiler, as a function of changes in its power. In this type of measurement of the heat transfer, a "small-mesh" porous film gives a temperature difference of 120° C. to 400° C. whereas this difference is 300° C. to 370° C. for a thick mesh porous film.

Figure 9:
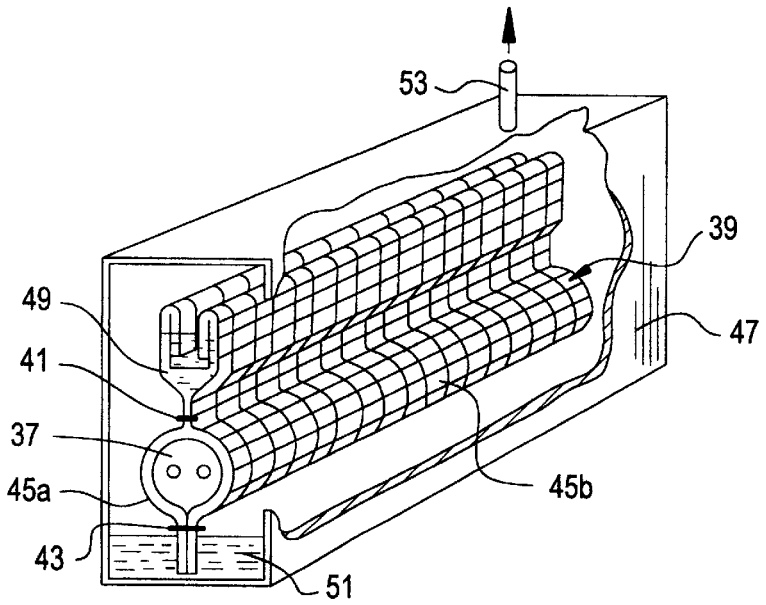
FIG. 9 is a cut-away perspective view of a steam, boiler using an electrical resistor of the cartridge type.

FIG. 9 is a cut-away perspective view of a variant of a steam generator using an electrical resistor. It is composed of a cartridge resistor 37 to the outer surface of which a fibrous substrate is applied and tightened thereon in the form of a flexible sleeve 39 sewn at 41 and 43 to form two half-surfaces 45*a*, 45*b* which extend towards the lower portion of the chamber 47, their upper portions being partially immersed in water in an upper tank 49 the level of which can be varied (by a supply pump) and their lower portions in a lower collecting container 51. The chamber also has an outlet for the steam 53 in its upper portion.

Measurements of the same type have been taken with this type of electrical-resistor boiler as with the gas boiler of FIGS. 5 and 6. Each of the following tables shows, for a constant flow-rate of water, the vaporization yield with variations in the heat flux density for four thicknesses of porous film.

| | | | | | | |
|---|---|---|---|---|---|---|
| 1) Porous film thickness 0.2 mm | | | | | | |
| Flux density in W/$cm^2$ | 2.50 | 3.30 | 5.00 | 6.10 | 6.90 | 8 |
| Vaporization yield g/Wh | 1.02 | 1.03 | 1.24 | 1.14 | | |
| 2) Porous film thickness 1 mm | | | | | | |
| Flux density in W/$cm^2$ | 2.50 | 3.30 | 5.00 | 6.10 | 6.90 | 8 |
| Vaporization yield | 0.89 | 1.04 | 1.16 | 1.20 | 1.24 | 1.28 |
| 3) Parallel-thread film thickness 2 mm | | | | | | |
| Flux density in W/$cm^2$ | 2.50 | 3.30 | 5.00 | 6.10 | 6.90 | 8 |
| Vaporization yield | 0.85 | 1.02 | 1.14 | 1.17 | 1.18 | 1.17 |
| 4) Parallel-thread film thickness 4 mm | | | | | | |
| Flux density in W/$cm^2$ | 2.50 | 3.30 | 5.00 | 6.10 | 6.90 | 8 |
| Vaporization yield | 0.85 | 1.02 | 1.10 | 1.11 | 1.10 | 1.08 |

Thus, for the same variations of heat-flux density, the variation of the vaporization yield observed is 20% for a thickness of 0.2 mm, 40% for a thickness of 1 mm, 30% for a thickness of 2 mm and 25% for a thickness of 4 mm.

In the case of a porous substrate of 1 mm thickness, at the optimum yield of 1.28 g/wh it is observed that there is practically no longer any flow of liquid to the lower portion of the substrate (assuming that it is arranged vertically). There is thus equivalence between the quantity of vaporizable liquid entering the porous film and the output of the heat source for a flux density of 8 W/$cm^2$.

Figure 11:
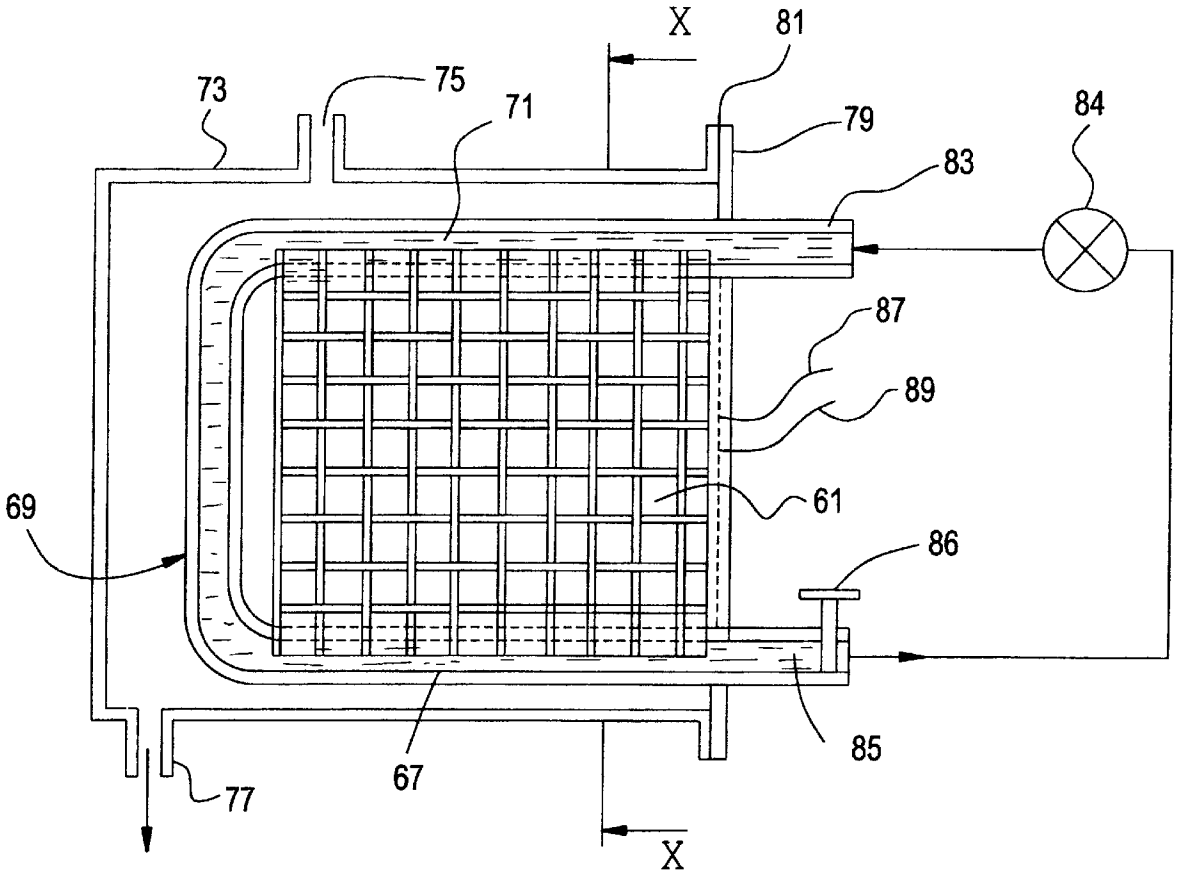
FIGS. 10 and 11 are section views taken along lines and XI—XI, respectively, of an electric vaporization device equipped with two porous substrates dipped locally in a pipe in which water to be vaporized, admitted by means of a pump, circulates.
Figure 10:
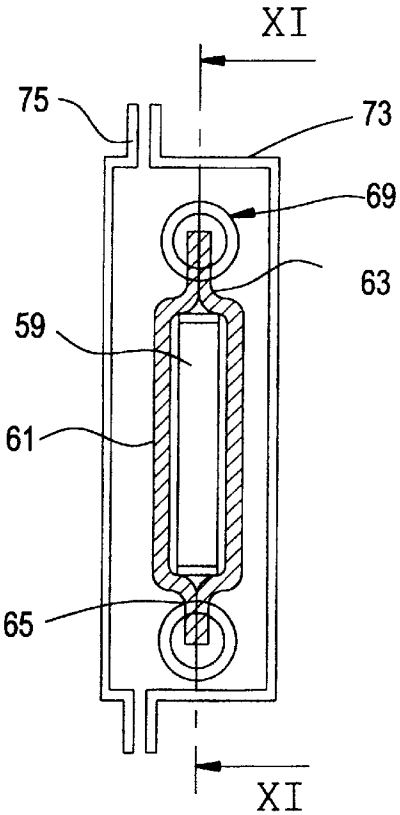

In FIGS. 10 and 11, the porous film is immersed locally in the water to be vaporized which circulates in a closed circuit in a pipe. This type of device can operate in different positions with the use of a pump and/or a regulating tap having the object of ensuring the pressurized supply of the substrate with water. The vaporization means comprise a rectangular resistor 59 with a power of 270 Watts. A cloth forming a woven film 61 is applied to and tightened on the resistor and is sewn at 63 and 65 to form a sleeve which extends downwardly and is housed and fixed inside the lower portion 67 of the pipe 69. This sleeve also extends into the upper portion 71 of the same pipe 69. The resistor is housed in a vaporization chamber 73. The vaporization chamber comprises a steam-outlet pipe 75 and a pipe 77 for discharging excess water when the flow-rate of circulation water is too great and a flange 79 fixed to the resistor in order to be fixed to the chamber at 81. The meshing of a flexible fabric has been shown, its upper and lower portions being dipped in the water through slots formed in the pipe 69 which the water enters at 83 and leaves again at 85 before being recirculated. Moreover, connections 87 and 89 allow the electrical resistor to be supplied.

In this device, the water is circulated by a pump 84, the flow-rate of which can be adjusted. The outlet 85 of the pipe has a tap 86. A slight excess pressure can thus be ensured in the pipe so that the liquid preferably flows into the porous film.

By adjustment of the tap the substrate can also be supersaturated with liquid, creating a film of water which is kept on the surface by the surface tension of the liquid on the faces of the porous film.

With the pump 84 and the tap 86, means are thus available for placing the liquid under a pressure greater than the ambient pressure in the chamber 73 upstream of the region in which the substrate 61 is exposed to the heat of the resistor 59, thus achieving in the substrate the flow-rate conditions already set out.

The following table snows the results achieved with this installation at a constant flux density of 4.7 w/cm$^2$ when the flow-rate of water supplied is varied and a "small-mesh" substrate of the type already shown is used.

| Flow-rate or Flow water g/mm | 7 | 15 | 22 | 30 | 40 | 50 | 57 |
|---|---|---|---|---|---|---|---|
| Vaporisation yield g/mn | 1.31 | 1.32 | 1.30 | 1.26 | 1.16 | 1.12 | 1.12 |

The vaporization yield in the porous substrate is thus 20% higher when the flow-rate of water entering is reduced from 57 g/mn to 15 g/mn.

Figure 12:
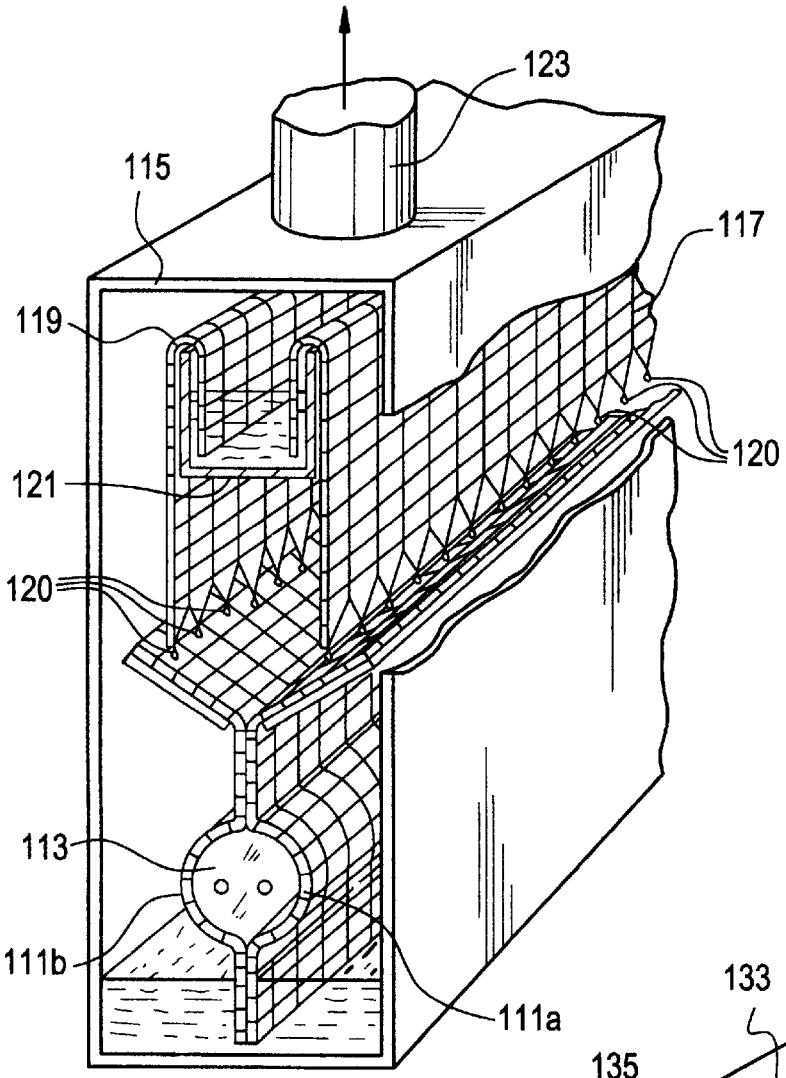
FIG. 12 is a partial cut-away perspective view of the drop-by-drop supply of a device according to the invention.

FIG. 12 is an example of a dripping device for supplying vaporization equipment comparable to that of FIG. 8. In this case, it is possible to achieve a good flow distribution over large widths of substrates and for very low flow-rates with the use of a whole range of interchangeable porous bodies establishing constant liquid flow-rates. Moreover, the flow-rate of liquid can easily be adapted to the vaporization source, or even so as to supersaturate the porous film. This device can also be used for trapping salts contained in the water or as an interchangeable liquid filter.

In this FIG. 12, a double woven substrate 111*a*, 111*b* is suspended around a tubular electrical resistor 113 in the lower portion of an evaporation chamber 115. The upper portion of the substrate is flared in a "V"-shape and rests on two supports. It is thus supplied, drop by drop, with liquid to be evaporated, by means of two fine woven rectangular substrates 117, 119 hanging vertically and terminating at their lower ends in fringes 120 favouring the dripping and good distribution of the liquid.

The upper portions of the substrates 117, 719 are dipped in a liquid-supply tank 121 with a variable depth of liquid filled by a supply not shown. A chimney 123 enables the steam to escape.

Figure 13:
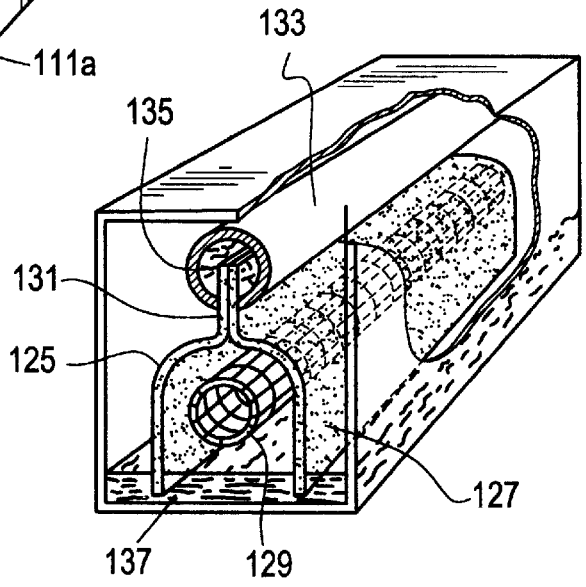
FIG. 13 is a partial, cut-away, perspective view of another generator producing steam by thermal radiation of a resistor.
Figure 1:
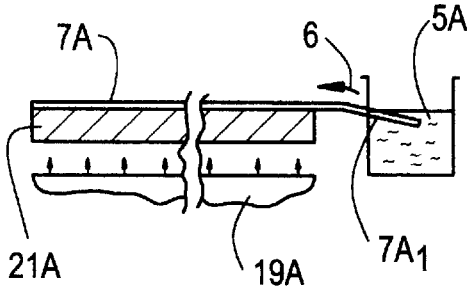

FIG. 13 shows a liquid vaporization device using at least one sintered stainless steel plate 1 mm thick. In this embodiment, the liquid is vaporized by thermal radiation of an electrical resistor.

In this particular embodiment, two "S"-shaped plates 125, 127 of a sintered stainless-steel alloy with a porosity of 30% were used and were arranged back to back to form an inverted "U"-shaped arch around the tubular resistor 129. These rigid plates are attached in their upper portions or are held at 131 in order to be engaged in a leaktight manner in a pipe 133 in which the liquid 135 to be vaporized circulates. Owing to this arrangement and to the fact that there is a slight pressure in the pipe (by virtue, for example, of a rump), the liquid flows into the empty spaces included in the two plates. The electrical resistor 129 is located in the center of the arch and 10 mm from the two walls and extends throughout the length of the arch. The excess liquid which has not been vaporized is collected at the bottom at 137, and can be readmitted to the input of the pipe 133 to contribute to the supply of the substrates.

If the porous walls 125, 127 are immersed locally in the reservoir pipe 133, this vaporization element can also be supplied by the dripping device of FIG. 12.

The method of the invention and the embodiments thereof are usable particularly in products of the handicrafts, general public, and do-it-yourself fields as well as in conversion industries and agricultural food industries. Steam, generators producing from a few kg of steam/hour to more than a tonne/hour can thus be created with the use of natural-gas combustion or electrical energy. These generators may be used, for example, in restaurant ovens, bakers' ovens, in the biscuit industry and in pre-cooking, in the textile industry for the treatment of fibres or, for example, for steam-pressing and dry-cleaning systems or for sterilization in biology laboratories. Steam generators may also be produced, for example, for individual laundry irons or for laundry irons with centralized steam systems or for floor and wall-cleaning equipment.

With regard to the range of heat-flux densities usable within the scope of the invention, it will also be noted that these may be from a few mW/cm$^2$ to several tens of W/cm$^2$.

Moreover, it should be clear that the device of the invention can operate at atmospheric pressure as well as at excess pressure or under vacuum, solely the pressurization of the liquid having to be provided to ensure the required the flow-rate conditions in the substrate.

We claim:

1. A device for vaporizing a liquid, the device comprising:

at least one porous substrate having a pre-determined width and a thickness, the thickness being between about 0.05 mm and about 5 mm, said at least one substrate further having an upstream portion and a downstream portion;

liquid supply means in liquid communication with at least a major part of said pre-determined width of the substrate upstream portion for distributing the liquid to be supplied to at least said major part of the width of the substrate and for causing a circulation of said liquid along said substrate from said upstream portion to said downstream portion thereof; and heating means for heating said porous substrate to a temperature adapted for vaporizing said liquid, the device configured such that, for a given thermal flux and substrate surface area, the quantity of liquid to be vaporized entering the porous substrates is optimally balanced with the thermal flux and substantially all liquid is vaporized out of said porous substrate between said upstream portion and said downstream portion thereof such that virtually no liquid remains in said substrate at said downstream portion.

2. A device according to claim 1, wherein:

said substrate is inclined relative to a horizontal axis so that said upstream portion thereof is disposed at a higher level than said downstream portion; and said liquid supply means provides said substrate with a delivery of liquid slightly greater than the flowing capacity of said liquid within said substrate so that a part of said liquid flows externally along said substrate while being maintained against the substrate by interfacial forces.

3. A device according to claim 1, wherein:

said substrate is inclined relative to a horizontal axis so that said upstream portion thereof is disposed at a higher level than said downstream portion; and said heating means extend in front of said substrate, substantially from the level of the downstream portion thereof to a level intermediate the levels of said downstream and upstream portions.

4. A device for vaporizing a liquid, the device comprising:

at least one flexible porous sheet having a pre-determined width and a thickness, the thickness being between about 0.05 mm and about 5 mm, said sheet further having an upstream portion and a downstream portion;

liquid supply means for supplying said flexible porous sheet with said liquid from said upstream portion, along at least a major part of said determined width thereof; and heating means for heating said flexible porous sheet to a temperature adapted for vaporizing said liquid, the device configured such that, for a given thermal flux and substrate surface area, the quantity of liquid to be vaporized entering the porous substrates is optimally balanced with the thermal flux and substantially all of said liquid is vaporized out of said flexible porous sheet between said upstream portion and said downstream portion thereof such that virtually no liquid remains in said substrate at said downstream portion.

5. A device according to claim 4, wherein said at least one flexible sheet comprises a permeable fibrous woven material.

6. A device for vaporizing a liquid, the device comprising:

at least one porous rigid plate having a determined width, an upstream portion, and a downstream portion and having at least one major surface exposed for vaporization of said liquid therefrom;

liquid supply means for supplying said porous rigid plate with said liquid from said upstream portion, along at least a major part of said determined width thereof; and heating means for heating said porous rigid plate to a temperature adapted for vaporizing said liquid, so that at least a part of said liquid is vaporized out of said porous rigid plate between said upstream portion and said downstream portion thereof.

7. A device according to claim 6, wherein said rigid plate is made of a sintered metal.

8. A device according to claim 6, wherein said porous rigid plate has a thickness between about 0.05 mm and about 5 mm.

9. A device for vaporizing a liquid, the device comprising:

at least one porous thin substrate subjected over part of its length to a pre-determined ambient pressure, said at least one substrate having a pre-determined width, a higher portion, and a lower portion;

liquid supply means extending along at least a major part of said pre-determined width of said at least one substrate and near said high portion thereof and adapted to create a column of liquid in said at least one substrate under a pressure which is higher than said ambient pressure, thereby forcing a flow of liquid under pressure greater than said ambient pressure between said high and low portions of said at least one substrate along at least said major part of the width thereof; and heating means for heating said at least one substrate to a temperature adapted for vaporizing said liquid, so that at least a part of said liquid is vaporized out of said at least one substrate between said higher portion and said lower portion thereof.

10. A device according to claim 9, wherein said liquid supply means comprise a tank containing said liquid and wherein said high portion of the substrate is sealed partially within and extends out of said tank and is immersed, along at least said major part of the width thereof, in the liquid in said tank.

11. A device according to claim 9, wherein said thin substrate has a thickness between about 0.05 mm and about 5 mm.

12. A device according to claim 9, further comprising:

at least two substrates disposed each in a hollow box defining a chimney therebetween; and wherein said heating means includes a gas burner disposed in said chimney.

13. A device for vaporizing a liquid, the device comprising:

a porous substrate subjected over part of its length to a pre-determined ambient pressure, said substrate having a pre-determined width and a thickness, the thickness being between about 0.05 mm and about 5 mm, said substrate further having an upstream portion and a downstream portion;

liquid supply means for supplying said substrate with said liquid, said liquid supply means being in liquid communication with at least a major part of said pre-determined width of the substrate upstream portion;

pressurizing means for pressurizing said liquid in said substrate to a pressure higher than said ambient pressure, thereby forcing said liquid to flow along at least said major part of the width of the substrate between said upstream and downstream portions; and heating means for heating said substrate to a temperature adapted for vaporizing said liquid so that at least a part of said liquid is vaporized out of said flexible porous sheet between said upstream portion and said downstream portion thereof.

14. A device according to claim 13, wherein:

said substrate is inclined relative to a horizontal axis so that said upstream portion thereof is disposed at a higher level than said downstream portion; and said heating means extend in front of said substrate, substantially from the level of the downstream portion thereof to a level intermediate the levels of said downstream and upstream portions.

15. A device for vaporizing a liquid, the device comprising:

a porous thin film subjected to a pre-determined ambient pressure, said porous thin film having an upstream portion, a downstream portion, and a pre-determined width;

liquid supply means for supplying said film with said liquid, said liquid supply means being in liquid communication with at least a major part of the width of said film upstream portion;

pressurizing means for pressurizing said liquid in said substrate to a pressure higher than said ambient pressure, thereby forcing said liquid to circulate in said porous thin film from said upstream portion to said downstream portion thereof;

liquid collecting means for collecting said liquid circulating in said downstream portion of the porous thin film, said upstream and downstream portions of the thin film being partially immersed in said liquid supply means and said liquid collecting means, respectively; and heating means for heating said porous thin film to a temperature adapted for vaporizing said liquid so that at least a part of said liquid is vaporized out of said film between said upstream portion and said downstream portion thereof.

16. A device according to claim 15, wherein said porous thin film has a thickness between about 0.05 mm and about 5 mm.

17. A device for vaporizing a liquid, the device comprising:

a plurality of porous thin substrates, each having a pre-determined width and a thickness, the thickness being between about 0.05 mm and about 5 mm, said substrates each further having an upstream portion and a downstream portion;

liquid supply means in liquid communication with the upstream portion of said substrates for supplying said liquid thereto and for creating a circulation of said liquid along said substrates from said upstream portion to said downstream portion thereof; and heating means for heating said substrates to a temperature adapted for vaporizing said liquid so that at least a part of said liquid is vaporized out of said substrates between said upstream portion and said downstream portion thereof, said plurality of substrates being inclined relative to a horizontal axis and some of said plurality of substrates overlapping others and forming therebetween a gap for the circulation of the vapour.

18. A device according to claim 17, wherein said substrates have a plate form shape having a pre-determined width.

19. A device according to claim 17, wherein said substrates are inclined relative to a horizontal axis so that said upstream portions thereof are disposed at a higher level than said downstream portions, thereby creating a column of said liquid along said substrates and forcing a flow of said liquid therein.

20. A device according to claim 18, wherein said heating means extend in front of at least said major part of the width of said substrates.

21. A device according to claim 18, wherein said liquid supply means extend in front of at least a major part of the width of said substrates so that said liquid is distributed to said upstream portions of said substrates on at least said major part of the width thereof.

* * * * *

UNITED STATES PATENT AND TRADEMARK OFFICE

CERTIFICATE OF CORRECTION

PATENT NO. : 5,771,845
DATED : June 30, 1998
INVENTOR(S) : Pistien et al.

It is certified that error appears in the above-identified patent and that said Letters Patent is hereby corrected as shown below:

Col. 1, line 40, before "with" insert -- - --.
Col. 1, line 42, before "with" insert -- - --.
Col. 1, line 45, before "with" insert -- - --.
Col. 1, line 53, "In so far" should be -- insofar --.
Col. 1, line 59, "d" should be -- a --.

Col. 2, line 18, "tho" should be -- the --.

Col. 3, line 8, after "pump" insert -- . --.
Col. 3, line 20, "or" should be -- of --.

Col. 4, line 61, "also is" should be -- is also --.

Col. 5, line 4, "or" should be -- as --.
Col. 5, line 51, after "steam" delete -- , --.
Col. 5, line 53, delete "and".
Col. 5, line 54, "X1-X1" should be -- x-x and x1-x1 --.

UNITED STATES PATENT AND TRADEMARK OFFICE

CERTIFICATE OF CORRECTION

PATENT NO. : 5,771,845
DATED : June 30, 1998
INVENTOR(S) : Pistien et al.

It is certified that error appears in the above-identified patent and that said Letters Patent is hereby corrected as shown below:

Col. 8, line 45, "1,03" should be -- 1.05 --.

Col. 9, line 38, "snows" should be -- shows --.

Col. 10, line 19, "rump" should be -- pump --.
Col. 10, line 50, delete "the" second occurrence.

Signed and Sealed this

Fourth Day of April, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT : 5,771,845

DATED : June 30, 1998

INVENTOR(S) : Pistien et al.

It is certified that error appears in the above-identified patent and that said Letters Patent is hereby corrected as shown below:

Col. 1, line 40, before "with" (first occurrence) insert -- - --.
Col. 1, line 42, before "with" (first occurrence) insert -- - --.
Col. 1, line 45, before "with" insert -- - --.
Col. 1, line 53, "In so far" should be --Insofar--.

Col. 2, line 18, "tho" should be -- the --.

Col. 3, line 8, after "pump" insert -- . --.
Col. 3, line 20, "or" should be -- of --.

Col. 4, line 61, "also is" should be -- is also --.

Col. 5, line 4, "or" should be -- as --.
Col. 5, line 51, after "steam" delete -- . --.
Col. 5, line 53, delete "and".
Col. 5, line 54, "X1-X1" should be -- X-X and XI-XI --.

UNITED STATES PATENT AND TRADEMARK OFFICE

CERTIFICATE OF CORRECTION

PATENT : 5,771,845 Page 2 of 2

DATED : June 30, 1998

INVENTOR(S) : Pistien et al.

It is certified that error appears in the above-identified patent and that said Letters Patent is hereby corrected as shown below:

Col. 8, line 45, "1,03" should be -- 1.05 --.

Col. 9, line 38, "snows" should be -- shows --.

Col. 10, line 19, "rump" should be -- pump --.
Col. 10, line 50, delete "the" (third occurrence).

This certificate of correction supersedes the certificate that issued on April 4, 2000.

Signed and Sealed this

Thirteenth Day of June, 2000

*Attest:*

Q. TODD DICKINSON

*Attesting Officer*

*Director of Patents and Trademarks*